US010150307B2

(12) United States Patent
Sakano

(10) Patent No.: US 10,150,307 B2
(45) Date of Patent: Dec. 11, 2018

(54) TAPE PRINTING DEVICE WITH SENSOR HOLDER

(71) Applicant: SEIKO EPSON CORPORATION, Tokyo (JP)

(72) Inventor: Hideki Sakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/558,361

(22) PCT Filed: Feb. 9, 2016

(86) PCT No.: PCT/JP2016/000670
§ 371 (c)(1),
(2) Date: Sep. 14, 2017

(87) PCT Pub. No.: WO2016/147542
PCT Pub. Date: Sep. 22, 2016

(65) Prior Publication Data

US 2018/0079228 A1 Mar. 22, 2018

(30) Foreign Application Priority Data

Mar. 18, 2015 (JP) ..... 2015-055148

(51) Int. Cl.

| | |
|---|---|
| ***B41J 3/36*** | (2006.01) |
| ***B41J 15/04*** | (2006.01) |
| ***B41J 11/00*** | (2006.01) |
| ***B41J 2/325*** | (2006.01) |
| ***B41J 3/407*** | (2006.01) |

(52) U.S. Cl.
CPC ..... *B41J 11/009* (2013.01); *B41J 2/325* (2013.01); *B41J 3/36* (2013.01); *B41J 3/4075* (2013.01); *B41J 15/04* (2013.01)

(58) Field of Classification Search
CPC ..... B41J 11/009; B41J 2/325; B41J 3/4075
See application file for complete search history.

(56) References Cited

U.S. PATENT DOCUMENTS 5,079,565 A * 1/1992 Shimizu ..... B41J 17/32 235/469

FOREIGN PATENT DOCUMENTS

| | | | |
|---|---|---|---|
| JP | 02-095875 | A | 4/1990 |
| JP | 3247585 | B | 11/2001 |
| JP | 3247585 | B2 * | 1/2002 |

OTHER PUBLICATIONS

International Search Report dated Apr. 19, 2016 in PCT/JP2016/000670 with English-language translation (4 pgs.).

* cited by examiner

*Primary Examiner* — Bradley Thies
(74) *Attorney, Agent, or Firm* — Foley & Lardner LLP

(57) ABSTRACT

A tape printing device on which a tape cartridge is mounted, the device includes a sensor unit that faces a specification reading pattern formed on a base end surface of the tape cartridge; and a unit energizing portion that energizes the sensor unit toward a base end surface side. The sensor unit has a sensor portion that irradiates a specification reading pattern with a detection light and reads the specification reading pattern, and a sensor holder that supports the sensor portion and presses the base end surface by energizing of the unit energizing portion.

6 Claims, 11 Drawing Sheets

(a)

(b)

TAPE PRINTING DEVICE WITH SENSOR HOLDER

TECHNICAL FIELD

The present invention relates to a tape printing device on which a tape cartridge is mounted.

Background Art

In the related art, as a tape printing device (tape writer), a tape printing device including a cartridge mounting portion for detachably mounting the tape cartridge, and five photointerrupters that are arranged on an inner wall of the cartridge mounting portion in a line is known (see PTL 1). The tape cartridge which is mounted on the tape printing device has a specification display seal for identifying the specification of a printing tape and printing ink in a side surface portion thereof. The five photointerrupters are disposed so as to face the specification display seal. Then, the five photointerrupters detect whether or not black ink is printed in five specification display portions formed in the specification display seal and identify the specification based on a detection result.

CITATION LIST

Patent Literature

PTL 1: Japanese Patent No. 3247585

SUMMARY OF INVENTION

Technical Problem

However, in the tape printing device of this type, play on manufacturing tolerance is inevitably provided between the tape cartridge and the cartridge mounting portion. As a result, a position of the mounted tape cartridge may be positioned so as to be shifted by the tolerance. That is, the position of the tape cartridge is positioned so as to be shifted by the tolerance with respect to each photointerrupter.

Thus, in the configuration of the related art described above, a positional relationship between each photointerrupter and each specification display portion (specification display seal) provided in the tape cartridge is shifted. Therefore, there is a problem that a distance from each photointerrupter to each specification display portion is shifted from an optimum distance for detection by each photointerrupter. Therefore, there is a concern that detection ability by each photointerrupter is lowered and the specification cannot be correctly identified.

An object of the present invention is to provide a tape printing device which is able to cause a distance from a detection portion of the tape printing device to a portion to be detected of a tape cartridge to be an optimum distance and to improve a detection ability by the detection portion.

Solution to Problem

According to the present invention, there is provided a tape printing device on which a tape cartridge is mounted, the device including a sensor unit that faces a portion to be detected formed on a predetermined wall surface of the tape cartridge; and a energizing portion that energizes the sensor unit toward a predetermined wall surface side. The sensor unit has a detection portion that irradiates the portion to be detected with a detection light and reads the portion to be detected, and a holder that supports the detection portion and presses the predetermined wall surface by energizing of the energizing portion.

According to the configuration, the holder that supports the detection portion is pressed against the wall surface (predetermined wall surface) of the tape cartridge on which the portion to be detected is formed and is in close contact with the wall surface. Therefore, it is possible to perform positioning the detection portion with respect to the wall surface at an optimum position. That is, the holder can function as a spacer that forms a predetermined interval between the detection portion and the wall surface on which the portion to be detected is formed. Therefore, a distance from the detection portion to the portion to be detected can be an optimum distance. Therefore, a detection ability of the detection portion can be improved.

In this case, it is preferable that the holder have an external light shielding portion that covers the detection portion and shields an external light incident on the detection portion.

According to the configuration, the external light shielding portion that shields the incidence of the external light is provided in the holder which is in close contact with a formation surface for the portion to be detected. Therefore, it is possible to suppress that the external light is incident on the detection portion by entering between the detection portion and the formation surface for the portion to be detected. Therefore, the detection ability of the detection portion can be improved.

In addition, it is preferable that the detection portion have a plurality of optical sensors, and the holder have a partition member that prevents the detection light reflected from the portion to be detected and incident on the optical sensors from interfering with each other between the optical sensors.

According to the configuration, it is possible to prevent the optical sensors from interfering with each other. Thus, the detection ability of the detection portion can be improved.

On the other hand, it is preferable that the predetermined wall surface be a side wall surface that follows a mounting direction in which the tape cartridge is mounted, an end portion of the holder on a front side in the mounting direction have a leading inclined surface, and the leading inclined surface abut against a corner portion of the tape cartridge on a back side in the mounting direction and cause a part of a force for mounting the tape cartridge to act as a force for pushing the holder back.

According to the configuration, when the tape cartridge is mounted, the holder extending to a mounting area of the tape cartridge by the energizing portion is pushed to a position, at which mounting of the tape cartridge is not interfered, by the leading inclined surface. Therefore, the holder is in a pressed state against the tape cartridge (the predetermined wall surface thereof) due to a restoring force of the energizing portion caused by pushing of the holder back. As described above, it is possible to easily and automatically create a state in which the holder is pressed against the tape cartridge without performing any special operation or control.

In addition, it is preferable that the predetermined wall surface be a side wall surface that follows the mounting direction in which the tape cartridge is mounted, and the holder be formed with a positioning protrusion portion engaging with a hole portion formed on a wall surface on a back side in the mounting direction of the tape cartridge from the back side in the mounting direction.

According to the configuration, in a state in which the holder is pressed against the tape cartridge, the hole portion of the tape cartridge and the positioning protrusion portion of the holder are engaged with each other. Therefore, the holder and the tape cartridge are in firmly close contact with each other, and the holder and the tape cartridge are integrated. Therefore, the distance from the detection portion to the portion to be detected can be made more strictly the optimum distance. In addition, it is possible to maintain the optimum distance more firmly.

DESCRIPTION OF EMBODIMENTS

Hereinafter, a tape printing device according to an embodiment of the invention will be described with reference to the drawings together with a tape cartridge mounted on the tape printing device. The tape printing device is provided to create a label (tape piece) by performing printing while feeding a printing tape and an ink ribbon from the mounted tape cartridge and cutting a printed portion of the printing tape.

[Overview of Tape Printing Device]

Figure 1:
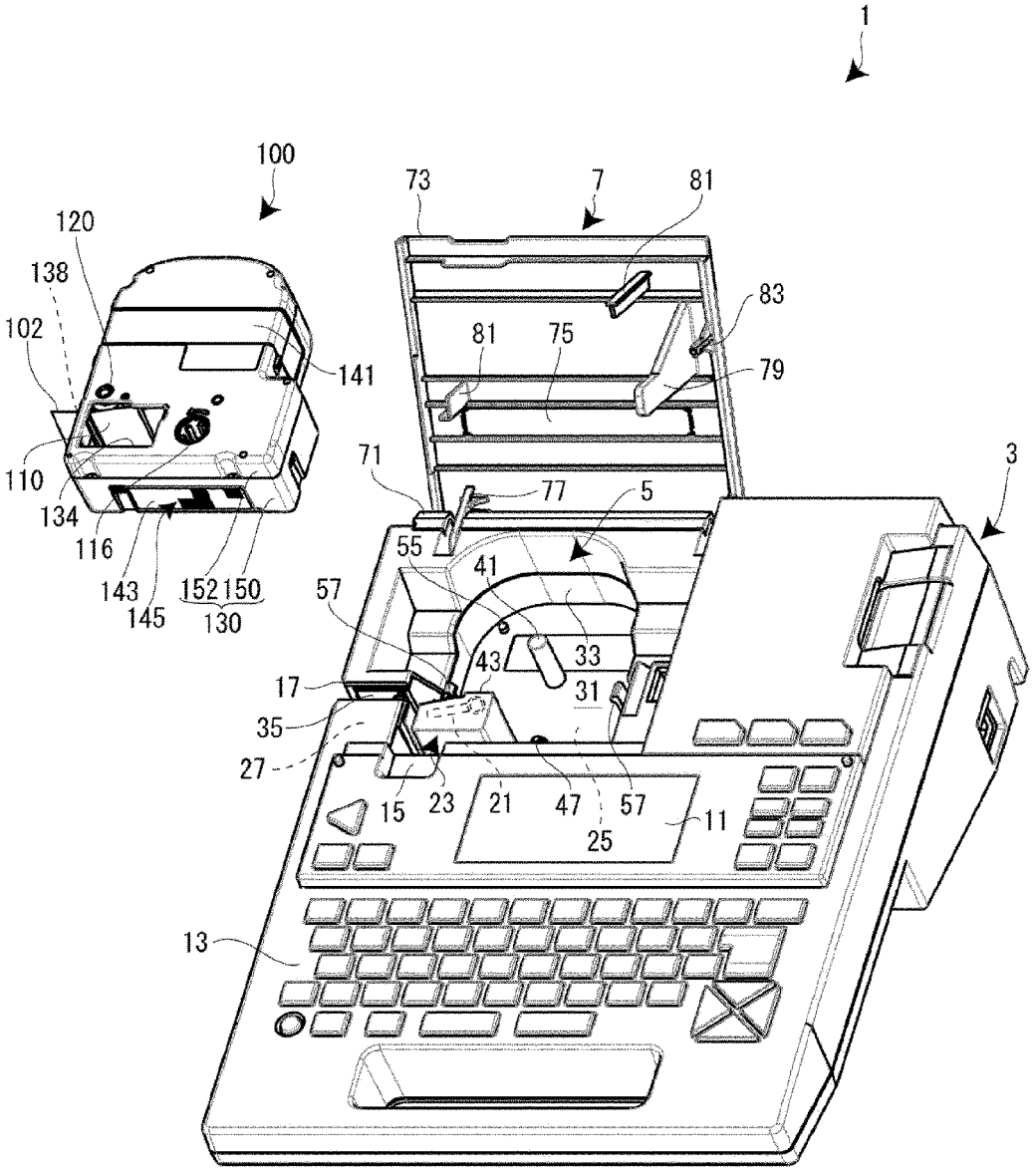
FIG. 1 is an external perspective view of a lid opening state of a tape printing device according to an embodiment.

FIG. 1 is an external perspective view of the tape printing device and the tape cartridge mounted on the tape printing device. As illustrated in the view, a tape printing device 1 includes a device case 3 configuring an outer shell, a cartridge mounting portion 5 on which a tape cartridge 100 is detachably mounted, and an opening and closing lid 7 that opens and closes the cartridge mounting portion 5. The cartridge mounting portion 5 is provided on a back side, a display 11 is provided in the center, and a keyboard 13 is provided on a front side on an upper surface of the device case 3. A mounting direction in which the tape cartridge 100 is mounted on the cartridge mounting portion 5 is a downward direction and a removing direction in which the tape cartridge 100 is removed from the cartridge mounting portion 5 is an upward direction. A finger hooking recessed portion 15 is provided in the vicinity of the opening and closing lid 7. The opening and closing lid 7 is opened by pulling the finger hooking recessed portion 15 up by a finger. Then, an elongated tape discharge port 17 from which a printing tape 102 is discharged is provided on a side surface (left side surface) of the device case 3.

In addition, the tape printing device 1 includes a printing mechanism portion 23 that has a printing head 21 provided uprightly in the cartridge mounting portion 5, a tape feeding mechanism 25 that is built in a rear space of the cartridge mounting portion 5, and a tape cutting mechanism 27 that is built in the vicinity of the tape discharge port 17. A user inputs printing information from the keyboard 13, recognizes the printing information in the display 11, and then executes printing with a key operation. If printing is commanded, the tape feeding mechanism 25 is driven and thereby the printing tape 102 and an ink ribbon 110 run in parallel. Furthermore, ink of the ink ribbon 110 is transferred to the printing tape 102 by heat applied from the printing mechanism portion 23 to the ink ribbon 110 and thereby printing is performed. The printing tape 102 is discharged from the tape discharge port 17 by print feeding and if printing is completed, the tape cutting mechanism 27 is driven and thereby a printed portion of the printing tape 102 is cut.

[Overview of Tape Cartridge]

Figure 2:
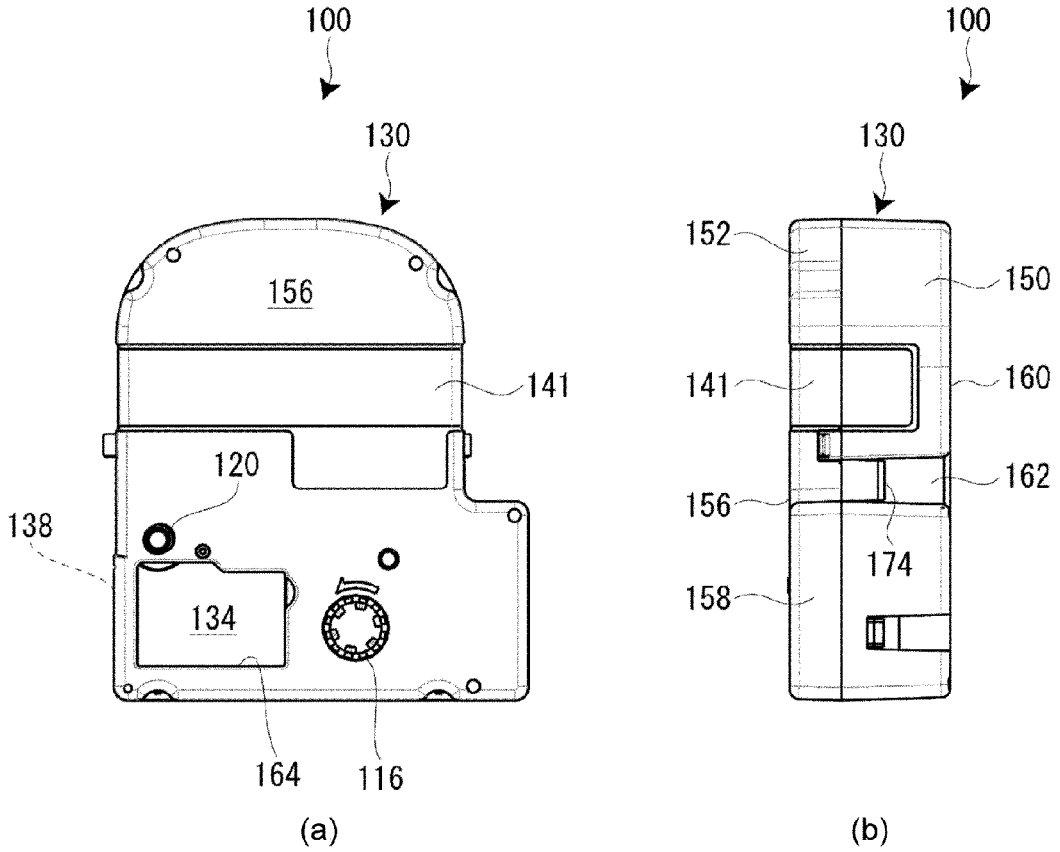
FIG. 2(*a*) is a plan view and 2(*b*) is a side view of a tape cartridge according to the embodiment.
Figure 5:
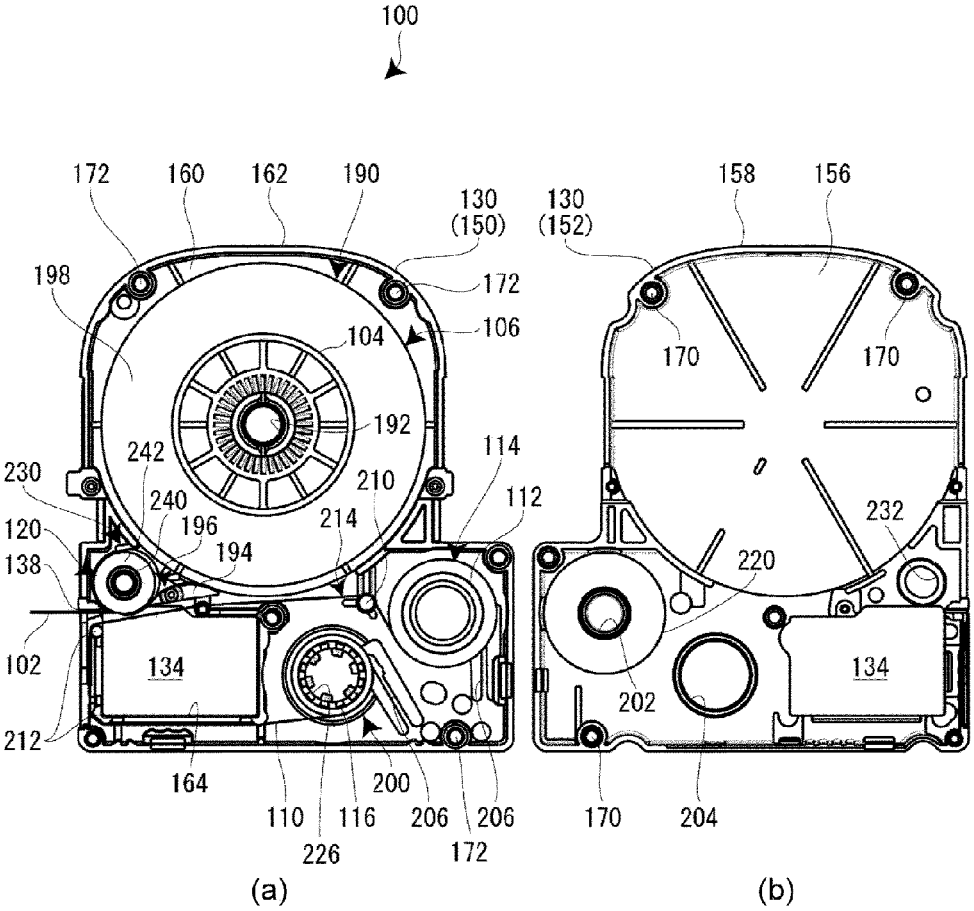
FIG. 5(*a*) is a plan view of the tape cartridge in a state in which an upper case is removed and 5(*b*) is a back side view of the upper case.

As illustrated in FIGS. 2 and 5, the tape cartridge 100 includes a tape roll 106 that winds the printing tape 102 into a tape core 104 and a ribbon roll 114 that winds the ink ribbon 110 into a feeding core 112. In addition, the tape cartridge 100 includes a winding core 116 that winds the ink ribbon 110 after use and a platen roller 120 against which the printing head 21 abuts and which delivers the printing tape 102 and the ink ribbon 110. Furthermore, the tape cartridge 100 includes a cartridge case 130 that houses the tape roll 106, the ribbon roll 114, the winding core 116, and the platen roller 120. As described above, the tape cartridge 100 of the embodiment has a so-called shell structure in which an outer shell is covered by the cartridge case 130.

In addition, when the tape cartridge 100 is mounted on the tape printing device 1, an insertion opening 134 into which the printing head 21 is inserted is formed in the cartridge case 130 in the tape cartridge 100. Furthermore, the tape cartridge 100 includes a tape feeding port 138 which is formed in the cartridge case 130 and from which the printing tape 102 is fed. Moreover, the tape roll 106, which is described later, is rotatably supported on a cylindrical core shaft 192 protruding on the inside of the cartridge case 130.

If the platen roller 120 and the winding core 116 are driven by the tape feeding mechanism 25 described above, the printing tape 102 is fed from the tape core 104 and the ink ribbon 110 is fed from the feeding core 112. The printing tape 102 and the ink ribbon 110, which are fed, run in parallel in the platen roller 120 portion and are subjected to printing by the printing head 21. A feeding end portion (printed portion) of the printing tape 102, in which printing is performed, is fed from the tape feeding port 138 to the tape discharge port 17. On the other hand, the ink ribbon 110 rotates around a peripheral wall portion of the insertion opening 134 and is wound on the winding core 116. Moreover, a plurality of specifications of printing tapes having different thicknesses according to a tape width of the printing tape 102 are prepared in the tape cartridge 100.

[Details of Tape Printing Device]

Figure 3:
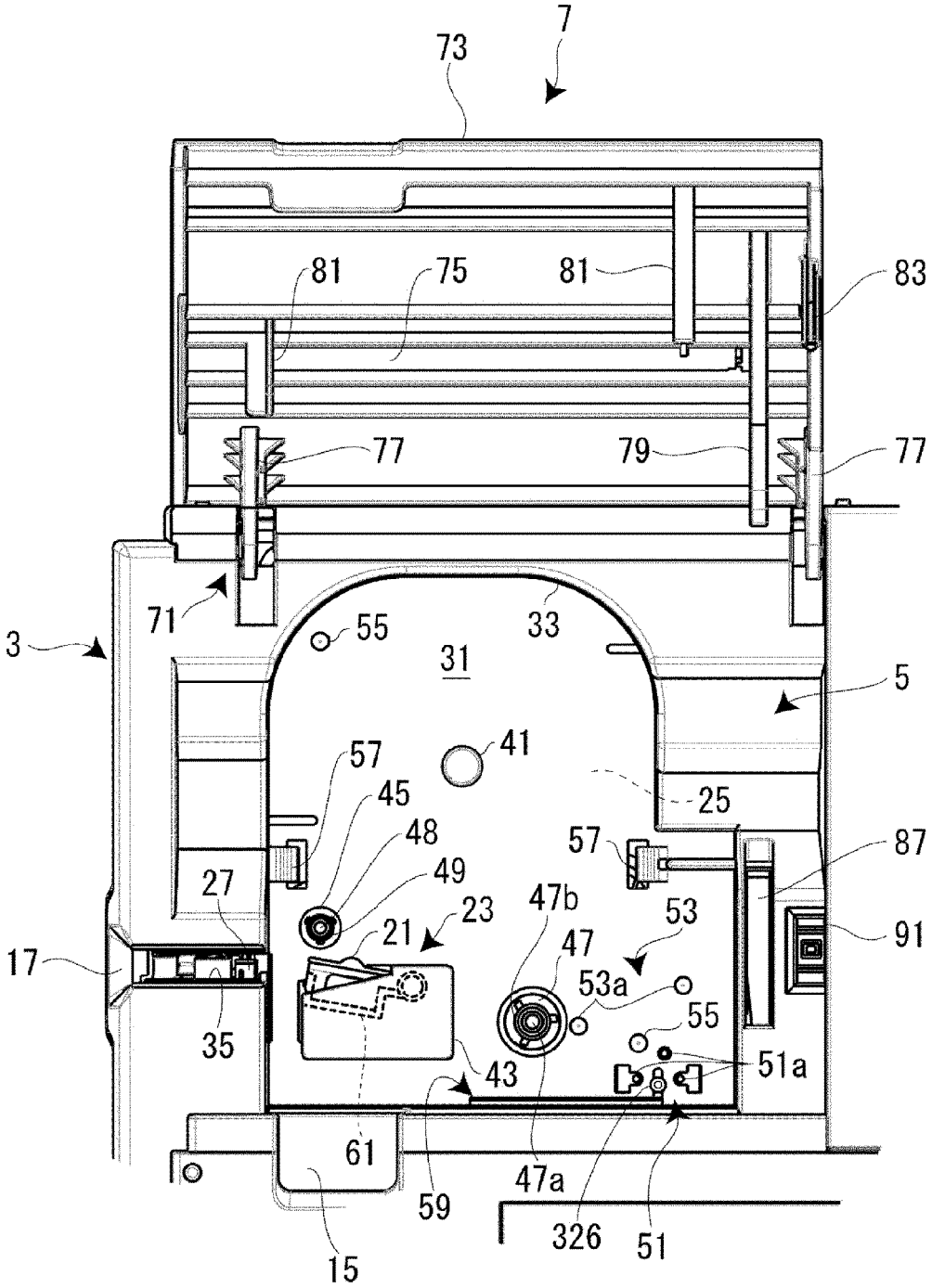
FIG. 3 is a plan view of a cartridge mounting portion.

As illustrated in FIGS. 1 and 3, the cartridge mounting portion 5 is formed in a complementary planar shape with a planar shape of the tape cartridge 100 and is formed in a recessed shape having a depth corresponding to the tape cartridge 100 of the maximum thickness among a plurality of specifications of tape cartridges 100 which are mountable. In this case, a mounting base 31 configuring a bottom plate portion of the cartridge mounting portion 5 and a side plate portion 33 are integrally formed (molding) of resin and the like. A slit-shaped tape discharge path 35 is formed between the cartridge mounting portion 5 and the tape discharge port 17, and the tape cutting mechanism 27 is built into the portion.

A positioning protrusion 41 which is positioned by fitting of the core shaft 192, the printing head 21 which is covered by a head cover 43, a platen driving shaft 45 which drives the platen roller 120 to rotate, and a winding driving shaft 47 which drives the winding core 116 to rotate are provided uprightly in the mounting base 31 of the cartridge mounting portion 5. In addition, a tape width detecting portion 51 which detects a tape width of the printing tape 102 and a core release portion 53 which releases rotation stoppers of the feeding core 112 and the winding core 116 are provided in positions in the vicinity of the winding driving shaft 47 in the mounting base 31.

Furthermore, a pair of small protrusions 55 is provided at diagonal positions in the mounting base 31. In addition, a pair of latch pieces 57 for latching a center portion of the mounted tape cartridge 100 is provided. On the other hand, the tape feeding mechanism 25 configured of a motor and a gear train (both not illustrated), and the like for rotating the platen driving shaft 45 and the winding driving shaft 47 is built into a rear space of the mounting base 31. The tape feeding mechanism 25 is power-branched in the gear train and synchronously rotates the platen driving shaft 45 and the winding driving shaft 47.

On the other hand, a pattern reading portion 59 for reading a specification reading pattern 145 described below provided on a side surface of the tape cartridge 100 is disposed in the side plate portion 33 (front side) of the cartridge mounting portion 5. In the embodiment, the tape width detecting portion 51 detects (recognizes) the tape width of the printing tape 102 housed in the tape cartridge 100 and the pattern reading portion 59 recognizes specification information (tape color and material of the housed printing tape 102, and ribbon color of the housed ink ribbon 110, and the like) of the tape cartridge 100 except the tape width. Details of the pattern reading portion 59 will be described later.

The printing mechanism portion 23 has the printing head 21 configured of a thermal head and a head support frame 61 that is rotated while supporting the printing head 21. In addition, the printing mechanism portion 23 has a head release mechanism (not illustrated) that rotates the printing head 21 between a printing position and a retracted position via the head support frame 61, and the head cover 43 that covers the printing head 21 (and the head support frame 61).

The head release mechanism is operated in conjunction with opening and closing of the opening and closing lid 7, and moves (rotates) the printing head 21 to the printing position in conjunction with a closing operation of the opening and closing lid 7. In addition, the head release mechanism causes the printing head 21 to be moved (rotated) to the retracted position in conjunction with an opening operation. The printing head 21 moved to the printing position abuts against the platen roller 120 via the ink ribbon 110 and the printing tape 102, and the printing head 21 moved to the retracted position is separated from the platen roller 120. Therefore, when mounting and demounting the tape cartridge 100, interference of the printing tape 102 and the ink ribbon 110 with the printing head 21 is prevented.

A plurality of heat generating elements are provided in the printing head 21 and the plurality of heat generating elements are arranged in parallel in the same direction as an axial direction of the platen roller 120. Then, printing is performed by delivery of the printing tape 102 and the ink ribbon 110, and selective driving of the plurality of heat generating elements. The head cover 43 is formed in a substantially rectangular shape in a plan view and is formed (molded) integrally with the mounting base 31 (cartridge mounting portion 5). In addition, the head cover 43 largely vertically protrudes from the mounting base 31, allows the rotation of the printing head 21 on the inside thereof, and functions as a mounting guide of the tape cartridge 100 on the outside.

The tape width detecting portion 51 is configured of a plurality of micro switches 51*a*, selectively engages with a detection hole group 180 of the tape cartridge 100 described below, and detects the tape width of the printing tape 102.

The core release portion 53 is configured of two release pins 53*a* for the feeding core 112 and the winding core 116. Although details will be described later, a rotation stopper hook 206 for latching each of the feeding core 112 and the winding core 116 is provided in the cartridge case 130 (see FIG. 6) and if the tape cartridge 100 is mounted, the release pin 53*a* is engaged with the rotation stopper hook 206 and the rotation stoppers of the feeding core 112 and the winding core 116 are released.

The platen driving shaft 45 has a platen support shaft 48 elongated so as to pass through the platen roller 120 and a spline-shaped rotation driving shaft 49 rotatably journaled on a base portion of the platen support shaft 48 (see FIG. 3). Rotational power of the tape feeding mechanism 25 is transmitted to the rotation driving shaft 49 and is further transmitted from the rotation driving shaft 49 to the platen roller 120 (details will be described later).

Similarly, the winding driving shaft 47 has a fixed shaft 47*a* and a spline-shaped movable shaft 47*b* rotatably journaled on the fixed shaft 47*a*. Also, in this case, rotational power of the tape feeding mechanism 25 is transmitted to the movable shaft 47*b* and is further transmitted from the movable shaft 47*b* to the winding core 116.

If the tape cartridge 100 is mounted on the cartridge mounting portion 5, the tape core 104 is engaged with the positioning protrusion 41, the platen roller 120 is engaged with the platen driving shaft 45, and the winding core 116 is further engaged with the winding driving shaft 47. Then, if the opening and closing lid 7 is closed, the printing head 21 is rotated and abuts against the platen roller 120 to interpose the printing tape 102 and the ink ribbon 110 therebetween, and the tape printing device 1 is in a printing standby state.

Figure 4:
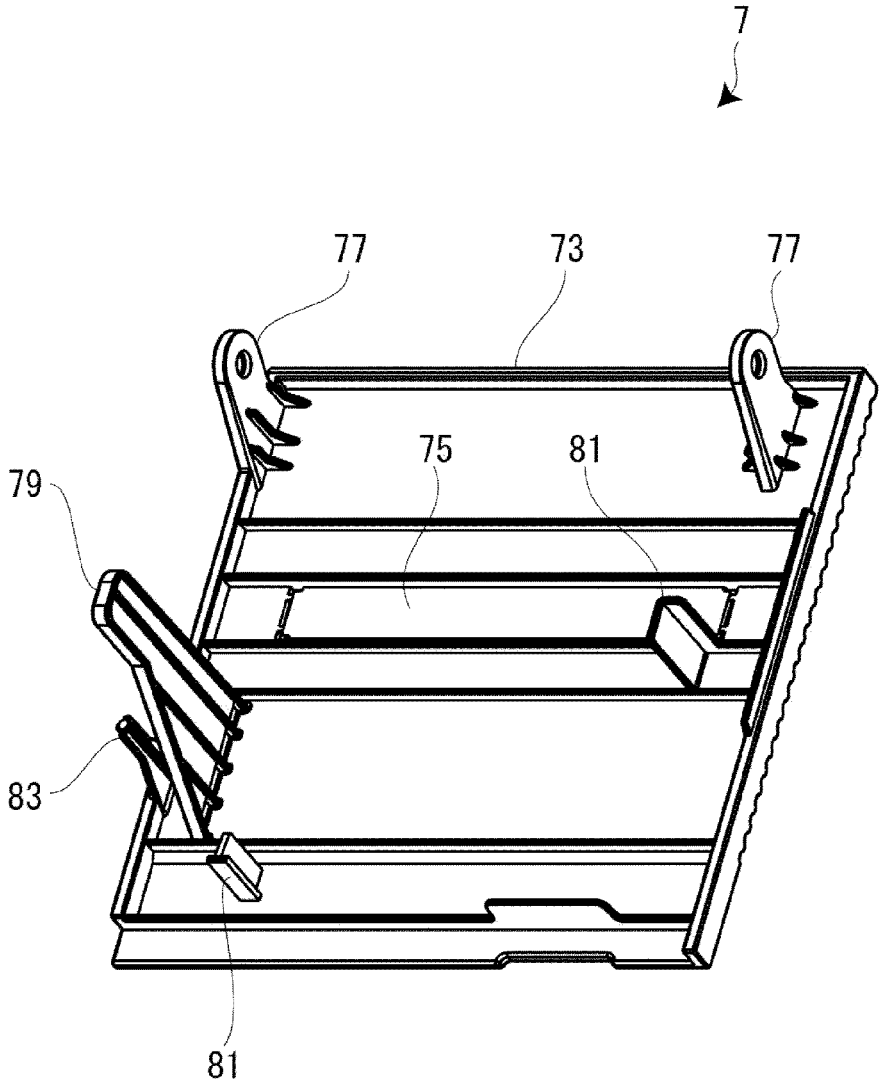
FIG. 4 is a perspective view of an opening and closing lid viewed from a back side.

As illustrated in FIGS. 1 and 4, the opening and closing lid 7 is rotatably, that is, open-closeably mounted on the device case 3 via a hinge portion 71 provided on a back side. The opening and closing lid 7 has an opening and closing lid body 73 and a viewing window 75 provided at the center of the opening and closing lid body 73. In addition, the opening and closing lid 7 has a pair of journal pieces 77 that are rotatably journaled on the hinge portion 71 protruding on the back surface of the opening and closing lid body 73 and an operation lever 79 that protrudes on the back surface of the opening and closing lid body 73 and rotates the printing head 21. Furthermore, the opening and closing lid 7 has two push protrusions 81 that protrude on the back surface of the opening and closing lid body 73 and press the tape cartridge 100, and a pressing protrusion 83 that protrudes on the back surface of the opening and closing lid body 73 and operates (ON) a built-in lid closing detection switch (not illustrated).

The viewing window 75 is formed to be horizontally elongated and is configured of transparent (transparent to visible light) resin as a separate body from the opening and closing lid body 73. The tape cartridge 100 mounted on the cartridge mounting portion 5 is visible (specification of the printing tape 102 and tape remaining amount) over the viewing window 75. In addition, the pair of journal pieces 77, the operation lever 79, the push protrusion 81, the pressing protrusion 83, and the opening and closing lid body 73 are integrally formed (molded) of resin.

The operation lever 79 largely protrudes from the back surface of the opening and closing lid body 73 and is inserted into a slit opening 87 provided on the side surface of the cartridge mounting portion 5 in accordance with closing of the opening and closing lid 7. The operation lever 79 inserted into the slit opening 87 operates the head release mechanism and rotates the printing head 21. Similarly, the pressing protrusion 83 is inserted into a rectangular opening 91 adjacent to the slit opening 87 and operates (ON) the lid closing detection switch in accordance with the closure of the opening and closing lid 7. The push protrusion 81 corresponds to a position in the vicinity of the platen roller 120 of the tape cartridge 100 and presses the tape cartridge 100 so that the tape cartridge 100 sits on the mounting base 31 of the cartridge mounting portion 5 in accordance with closing of the opening and closing lid 7.

[Details of Tape Cartridge]

Next, the tape cartridge 100 will be described in detail with reference to FIGS. 2, 5, and 6. Moreover, in the description of the tape cartridge 100, in the example of FIG. 2(*a*), a front surface in the mounting direction, which is an upper front surface of the tape cartridge 100, is referred to as a "front surface", a surface on the back side in the mounting direction on the opposite side is referred to as a "back surface", a side surface of the left side is referred to as a "left side surface", a side surface of the right side is referred to as a "right side surface", an arc-shaped side surface on the upper side is referred to as a "leading end surface", and a side surface on the lower side is referred to as a "base end surface". Moreover, the "side wall surface following the mounting direction" is the side surface of the tape cartridge 100 in the embodiment and the "wall surface on the back side in the mounting direction" is the back surface of the tape cartridge 100 in the embodiment. In addition, the "predetermined wall surface" is the base end surface of the tape cartridge 100 in the embodiment.

As described above, the tape cartridge 100 includes the cartridge case 130, the tape roll 106 housed therein, the ribbon roll 114, the winding core 116, and the platen roller 120. In addition, the tape cartridge 100 includes the insertion opening 134 formed in the cartridge case 130 and the tape feeding port 138 formed on the left side surface in the vicinity of the platen roller 120.

Furthermore, the tape cartridge 100 includes a specification display seal 141 adhered over the front surface, the left side surface, and the right side surface of a portion in which the tape roll 106 is housed, and a specification reading seal 143 adhered on the base end surface (both, see FIG. 1). Type information (tape width, a tape color, a material of the housed printing tape 102, and the like) of the tape cartridge 100 is displayed in the specification display seal 141. On the other hand, the specification reading pattern 145 (portion to be detected) indicating specification information (tape color and a material of the housed printing tape 102, and the like) of the tape cartridge 100 is formed in the specification reading seal 143. Details of the specification reading seal 143 will be described later.

The cartridge case 130 configures an outer shell of the tape cartridge 100 (shell structure) and has an appearance of an "L" shape in a plan view of which the base end side of the right side surface protrudes somewhat. The cartridge case 130 in a front and rear direction is configured of two members of a lower case 150 that becomes the back side and an upper case 152 that becomes the front side when being mounted on the cartridge mounting portion 5. The cartridge case 130 of the embodiment is configured such that the upper case 152 is formed of molding of transparent resin and the lower case 150 is formed of molding of opaque resin.

The upper case 152 is formed (molded) integrally with a top wall portion 156 configuring the surface of the cartridge case 130 and an upper periphery wall portion 158 provided uprightly in a periphery portion of the top wall portion 156. In addition, the lower case 150 is formed (molded) integrally with a bottom wall portion 160 configuring the rear surface of the cartridge case 130, a lower periphery wall 162 provided uprightly in the periphery portion of the bottom wall portion 160, and an opening periphery wall portion 164 vertically provided in the bottom wall portion 160 in order to form the insertion opening 134.

A plurality of joining pins 170 are provided on the lower end surface of the upper periphery wall portion 158 at appropriate intervals in the upper case 152 and a plurality of joining holes 172, which correspond to the plurality of joining pins 170 and to which the plurality of joining pins 170 are respectively joined, are provided in the lower periphery wall 162 of the lower case 150 (see FIG. 5). The tape cartridge 100 is assembled by joining the upper case 152 to the lower case 150 so as to press fit the plurality of joining pins 170 into the plurality of joining holes 172 after setting configuration components such as the tape roll 106 and the ribbon roll 114. Moreover, each joining hole 172 is configured of a through-hole in consideration of ease of molding.

Figure 6:
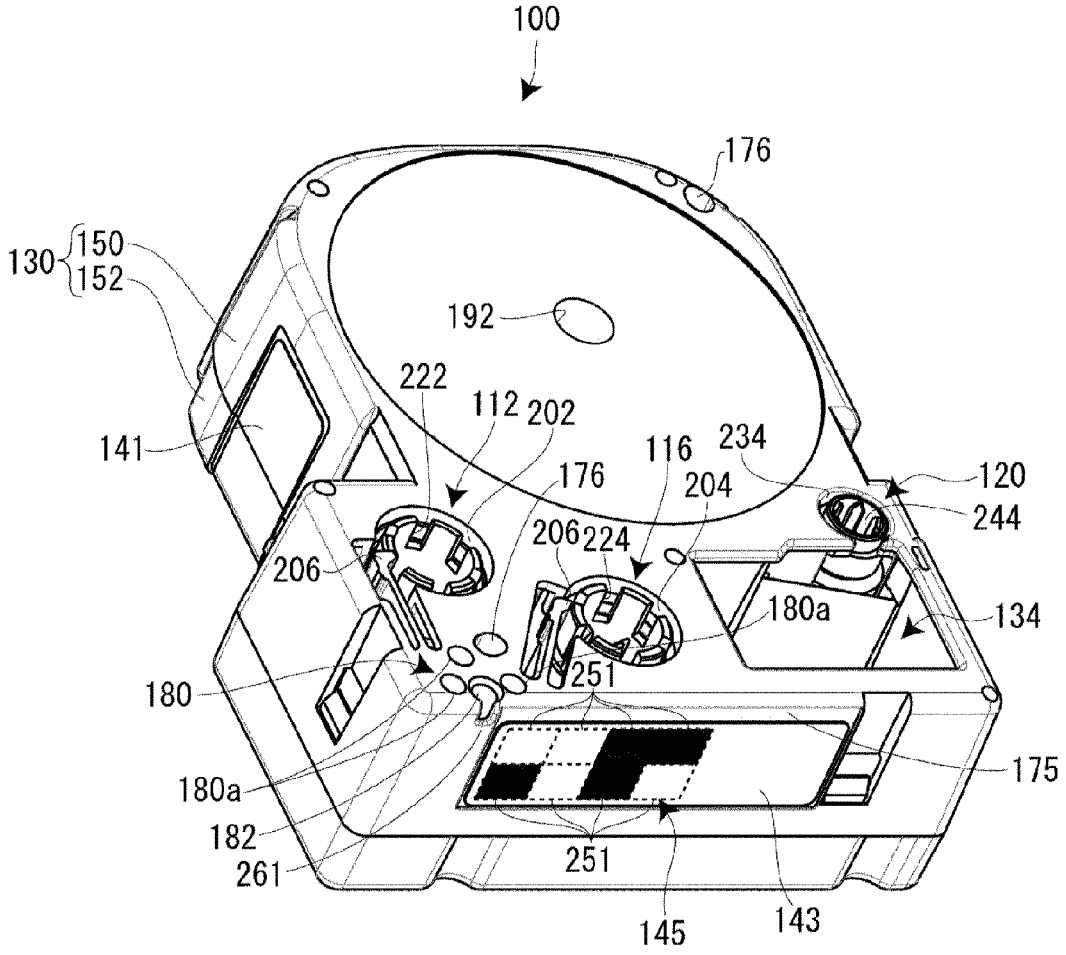
FIG. 6 is a perspective view of the tape cartridge viewed from the back side.

On the other hand, a pair of latch receiving portions 174 that are latched to the pair of latch pieces 57 of the cartridge mounting portion 5 are provided on the left side surface and the right side surface of the lower case 150 (see FIGS. 2 and 6). The pair of latch pieces 57 on the cartridge mounting portion 5 side are latched to the pair of latch receiving portions 174 of the mounted tape cartridge 100 and thereby floating of the tape cartridge 100 is prevented.

In addition, as illustrated in FIG. 6, a reading seal adhesive portion 175 for adhering to the specification reading seal is formed on the base end surface of the lower case 150. The reading seal adhesive portion 175 is recessed with respect to the base end surface so as to cause a rectangular recessed portion to have a depth equal (or equal to or greater than a thickness) to a thickness of the specification reading seal 143. The specification reading seal 143 is not protruded from the base end surface by the reading seal adhesive portion 175.

Furthermore, fitting small holes 176 into which the pair of small protrusions 55 are fitted with clearance somewhat are provided on the rear surface of the lower case 150. The pair of small protrusions 55 on the cartridge mounting portion 5 side are fitted into a pair of fitting small holes 176 of the mounted tape cartridge 100 and thereby simple positioning of the tape cartridge 100 is performed on the mounting base 31.

In addition, a detection hole group 180, which is positioned in a left corner portion (right corner portion viewed on the front surface side) on the base end surface side and corresponds to the tape width detecting portion 51, is provided on the rear surface of the lower case 150 (see FIG.

6). The detection hole group 180 indicates the bit pattern by the presence or absence of receiving holes 180*a* provided in a portion corresponding to a plurality of micro switches 51*a* of the tape width detecting portion 51. That is, the bit pattern indicates the tape width of the printing tape 102 housed in the tape cartridge 100 and the tape width detecting portion 51 detects the tape width of the printing tape 102 housed in the tape cartridge 100 by detecting the bit pattern by the plurality of micro switches 51*a*.

In addition, a positioning hole portion 182 (hole portion) engaged with a positioning pin 326 (described below) provided in the pattern reading portion 59 is disposed in the vicinity of the detection hole group 180. Details of the positioning hole portion 182 will be described later.

As illustrated in FIG. 5, a tape housing area 190, in which a wide tape roll 106 is housed, is configured in an upper side space (leading end surface side) within the cartridge case 130. The core shaft 192 formed (molded) integrally with the lower case 150 is provided uprightly at the center of the tape housing area 190. The core shaft 192 is formed in a cylinder shape and the tape roll 106 (tape core 104) is rotatably journaled on an outer peripheral surface thereof. In addition, a tape guide 194, which is positioned in the vicinity of the platen roller 120 and guides the fed printing tape 102 to the platen roller 120, is provided uprightly and integrally with the lower case 150 in the tape housing area 190.

That is, a tape delivery path 196 from the tape roll 106 as a starting point to the tape feeding port 138 through the tape guide 194 and the platen roller 120 is configured within the cartridge case 130. The printing tape 102 fed from the tape roll 106 is guided to the platen roller 120 via the tape guide 194, is subjected to printing in the platen roller 120, and is further guided from the platen roller 120 to the tape feeding port 138.

The tape roll 106 has the printing tape 102 and the tape core 104, and also has two films 198 adhered on both end surfaces of the printing tape 102 of a roll shape. The two films 198 prevent loosening of the printing tape 102 wound around the tape core 104. In addition, although not illustrated, a reverse rotation stop mechanism is incorporated in the tape core 104. When carrying the tape cartridge 100, the reverse rotation of the printing tape 102 is prevented by the reverse rotation stop mechanism. On the other hand, if the tape cartridge 100 is mounted on the cartridge mounting portion 5 of the tape printing device 1, the reverse rotation stop of the reverse rotation stop mechanism is released by the positioning protrusion 41 and delivery of the printing tape 102 may be performed.

A ribbon housing area 200 is configured adjacent to the insertion opening 134 on the right side of the base portion on the inside of the cartridge case 130. A feeding-side bearing portion 202 rotatably supporting the ribbon roll 114 (the feeding core 112) is formed integrally with the cartridge case 130 on the right side of the ribbon housing area 200 and a winding-side bearing portion 204 rotatably supporting the winding core 116 is formed integrally with the cartridge case 130 on the left side thereof. That is, the feeding-side bearing portion 202 and the winding-side bearing portion 204 are respectively formed in the upper case 152 and the lower case 150.

The rotation stopper hooks 206 of which leading end portions face the feeding-side bearing portion 202 and the winding-side bearing portion 204 are respectively and integrally formed in cutout portions of the feeding-side bearing portion 202 and the winding-side bearing portion 204 formed in the lower case 150. Then, one rotation stopper hook 206 is engaged with the feeding core 112 and the other rotation stopper hook 206 is engaged with the winding core 116 respectively in a rotation stop state.

A first ribbon guide 210, which is positioned in the vicinity of the feeding-side bearing portion 202 and guides the fed ink ribbon 110 to the platen roller 120 is provided uprightly and integrally with the lower case 150 in the ribbon housing area 200. In addition, a plurality of second ribbon guides 212, which guide circulation of the ink ribbon 110, are integrally formed on an outer periphery side of the opening periphery wall portion 164.

That is, a ribbon delivery path 214 from the ribbon roll 114 as a starting point to the winding core 116 through the first ribbon guide 210, the platen roller 120, and the plurality of second ribbon guides 212 is configured on the inside of the cartridge case 130. The ink ribbon 110 fed from the ribbon roll 114 is guided to the platen roller 120 via the first ribbon guide 210, where it is subjected to printing, and is wound around the winding core 116 by circulating the opening periphery wall portion 164 (plurality of second ribbon guides 212) from the platen roller 120.

The ribbon roll 114 has the ink ribbon 110 and the feeding core 112, and also has an annular leaf spring 220 applying a braking load to the feeding core 112 (see FIG. 5(*b*)). The leaf spring 220 is formed in a wave shape in a circumferential direction and is interposed between the top wall portion 156 of the upper case 152 and the feeding core 112 in the axial direction. That is, a rotational braking load is applied to the feeding core 112 by an elastic force of the leaf spring 220. Therefore, back tension is applied to the ink ribbon 110 that is fed by the winding core 116 and slack of the ink ribbon 110 is prevented.

The feeding core 112 is formed in a cylindrical shape and a plurality of cutouts 222 are formed in an end portion on the lower case 150 side in the circumferential direction (see FIG. 6). Then, the rotation stopper hooks 206 are engaged and disengaged with the plurality of cutouts 222. Moreover, the feeding-side bearing portion 202 on the lower case 150 side supporting the feeding core 112 is configured of a circular opening and the feeding-side bearing portion 202 on the upper case 152 side is configured of a cylindrical protrusion portion. Then, the leaf spring 220 is mounted on the protrusion portion (both, see FIG. 5(*b*)).

Similarly, the winding core 116 is formed in a cylindrical shape and a plurality of cutouts 224 are formed in an end portion on the lower case 150 side in the circumferential direction. Then, the rotation stopper hooks 206 are engaged and disengaged with the plurality of cutouts 224. In addition, spline grooves 226 are formed on an inner peripheral surface of the winding core 116 and are splined to the winding driving shaft 47. Therefore, the rotational force of the winding driving shaft 47 is transmitted to the winding core 116 and the ink ribbon 110 is wound.

A platen housing area 230 is configured adjacent to the insertion opening 134 on the left side of the base portion within the cartridge case 130. A lower bearing portion 234 (see FIG. 6) of an elliptical (oblong) opening formed in the lower case 150 and an upper bearing portion 232 (see FIG. 5(*b*)) of an elliptical opening formed in the upper case 152 are provided at the center of the platen housing area 230. Then, the platen roller 120 is supported on the upper bearing portion 232 and the lower bearing portion 234 rotatably and slightly movably in lateral direction. That is, the platen roller 120 supported on the upper bearing portion 232 and the lower bearing portion 234 having the elliptical shape is configured to be movable in the lateral direction (fine movement) between a home position to be engaged with the platen driving shaft 45 and a clamped position to come into contact with the tape guide 194 by sandwiching the printing tape 102.

Meanwhile, the tape cartridge 100 carries the feeding end portion of the printing tape 102 in a state of slightly protruding from the tape feeding port 138 to the outside (see FIG. 1). In this case, if a pushing force or a pulling force accidentally acts on the feeding end portion of the printing tape 102, the platen roller 120 dragged thereto is moved to the clamped position. Therefore, the feeding end portion of the printing tape 102 is prevented from being drawn from the tape feeding port 138 into the cartridge case 130.

The platen roller 120 has a cylindrical roller base body 240 and a rubber roller 242 mounted on an outer peripheral surface of the roller base body 240. The rubber roller 242 has a length corresponding to the printing head 21 in the axial direction and the printing head 21 moved to the printed position comes into contact with the rubber roller 242 by sandwiching the printing tape 102 and the ink ribbon 110. In addition, spline grooves 244 are formed on an inner peripheral surface of the roller base body 240 and the rotation driving shaft 49 of the platen driving shaft 45 is splined into the spline grooves 244. Therefore, the rotational force of the platen driving shaft 45 is transmitted to the platen roller 120 and print feeding of the printing tape 102 (and the ink ribbon 110) is performed.

[Details of Type Reading Seal, Positioning Hole Portion, and Pattern Reading Portion]

Next, the specification reading seal 143, the positioning hole portion 182, and the pattern reading portion 59 will be described with reference to FIGS. 6 to 10. First, the specification reading seal 143 and the positioning hole portion 182 of the tape cartridge 100 will be described with reference to FIGS. 6 and 7.

Figure 7:
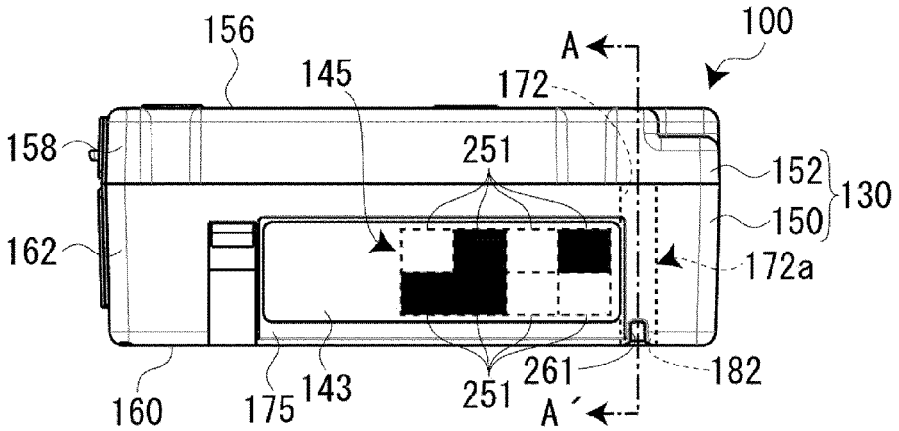
FIG. 7(*a*) is a bottom side view of the tape cartridge and 7(*b*) is a sectional view that is taken along line A-A' illustrating around a positioning hole portion.
Figure 7:
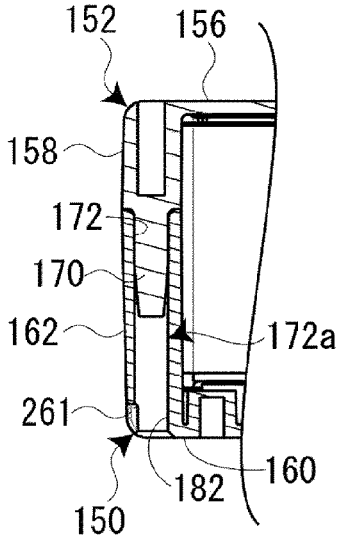

As illustrated in FIGS. 6 and 7(*a*), the specification reading seal 143 is adhered to the base end surface of the tape cartridge 100. Therefore, the specification reading seal 143 is formed with the specification reading pattern 145 indicating the specification information (the tape color and the material of the housed printing tape 102, the ribbon color of the housed ink ribbon 110, and the like) of the tape cartridge 100. As described above, in the embodiment, the specification reading seal 143 formed with the specification reading pattern 145 is adhered to the base end surface of the tape cartridge 100 thereby forming the specification reading pattern 145 on the base end surface of the tape cartridge 100.

The specification reading pattern 145 has eight bit configuration portions 251 disposed in a matrix with two rows and four columns. Each bit configuration portion 251 displays, for example, bit information of each one bit by whether or not black ink is printed (solid printing) in a white printing region. That is, a bit pattern of eight bits is displayed by total eight bit configuration portions 251. The bit pattern of eight bits is corresponds to various specifications of information described above and various specifications of information are displayed by the bit pattern. Moreover, for the sake of convenience of description, broken lines of reference numeral 251 of FIGS. 6 and 7(*a*) are illustrated to indicate the bit configuration portion 251 and are not actually formed. In addition, in the embodiment, the bit configuration portion 251 has a configuration in which the bit information is indicated by whether or not the black ink is printed in the white printing region, but the configuration is not limited to the embodiment. That is, the printing region or the color of ink printed on the printing region may be another color and pattern as long as it can be identified by a sensor unit 300 which is described below.

As illustrated in FIGS. 6 and 7(*b*), the positioning hole portion 182 is formed in the bottom wall portion 160 of the lower case 150 and is formed the rear surface of the tape cartridge 100. In addition, the positioning hole portion 182 is disposed coaxially with the joining hole 172 positioned the right corner portion and is configured by a lower end portion a through-hole 172*a* configuring the joining hole 172. That is, the positioning hole portion 182 and the joining hole 172 are configured of the integral through-hole 172*a*. Moreover, reference numeral 261 is a cutout portion corresponding to a connection portion 328 which is described below.

Figure 8:
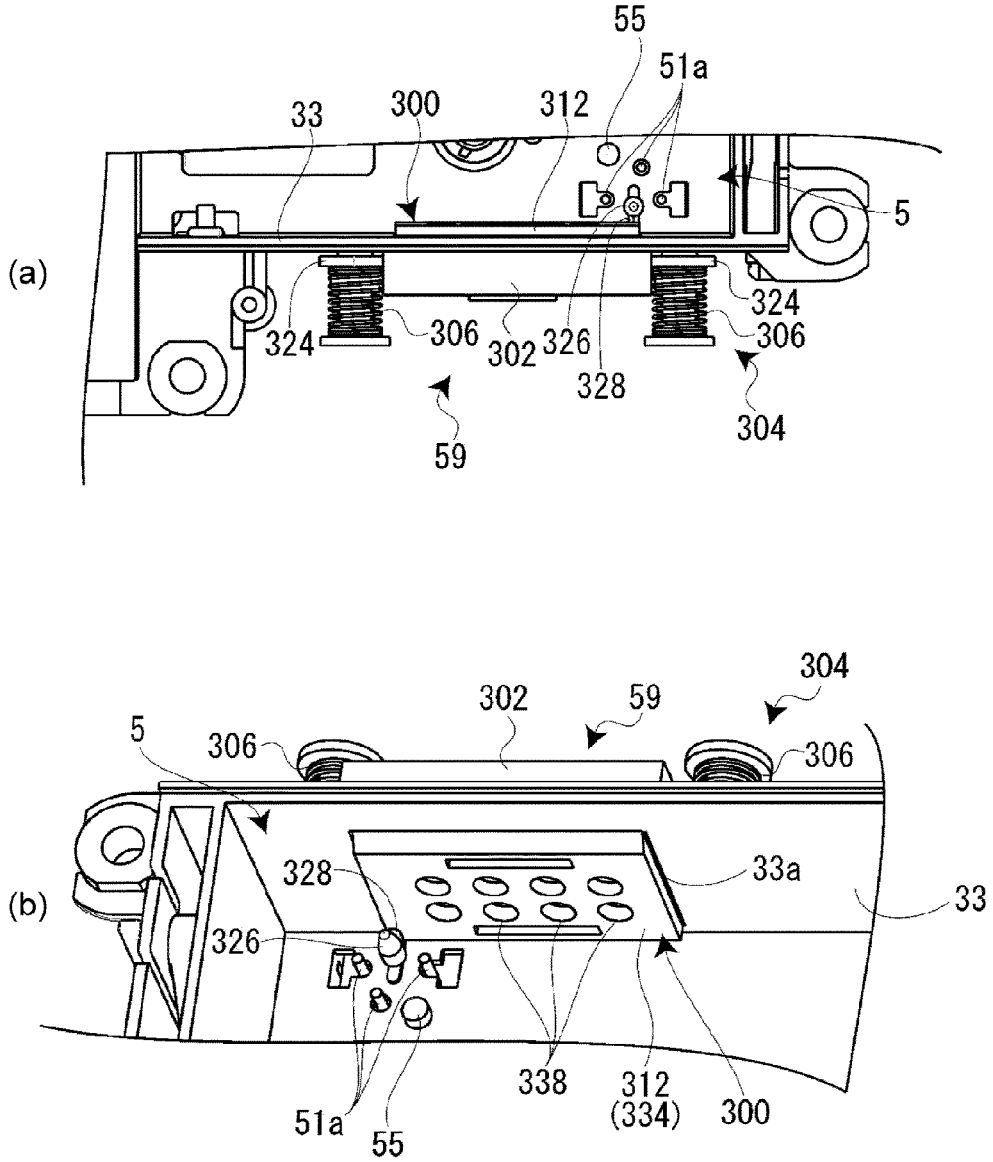
FIG. 8(*a*) is a plan view and 8(*b*) is a perspective view around a pattern reading portion.

Next, the pattern reading portion 59 of the tape printing device 1 will be described with reference to FIGS. 8 to 10. As illustrated in FIG. 8, the pattern reading portion 59 is provided in the side plate portion 33 (front side) of the cartridge mounting portion 5 and is disposed toward the inside of the cartridge mounting portion 5. That is, the pattern reading portion 59 is disposed in a position facing the base end surface of the tape cartridge 100 when the tape cartridge 100 is mounted on the cartridge mounting portion 5. The pattern reading portion 59 includes the sensor unit 300 that is disposed toward the inside of the cartridge mounting portion 5, a unit support portion 302 that movably supports the sensor unit 300, and a unit energizing portion 304 (energizing portion) that energizes the sensor unit 300 toward the inside of the cartridge mounting portion 5. The sensor unit 300 is disposed in a position facing the specification reading pattern 145 of the tape cartridge 100 when mounting the tape cartridge 100.

The unit support portion 302 is provided in an opening portion 33*a* opened to the side plate portion 33 of the cartridge mounting portion 5 and supports the sensor unit 300 to be movable to the inside and the outside of the cartridge mounting portion 5. That is, the unit support portion 302 supports the sensor unit 300 movably in a forward and rearward direction.

The unit energizing portion 304 has, for example, a pair of right and left coil springs 306 and energizes a pair of spring receiving portions 324 (described below) provided in the sensor unit 300 by the pair of coil springs 306. That is, the unit energizing portion 304 energizes the sensor unit 300 toward inside of the cartridge mounting portion 5 via the pair of spring receiving portions 324 by the pair of coil springs 306. In a state in which the tape cartridge 100 is not mounted, the sensor unit 300 is in a state of extending toward inside of the cartridge mounting portion 5, that is, the mounting area of the tape cartridge 100 by theenergizing. On the other hand, in a state in which the tape cartridge 100 is mounted, the sensor unit 300 is energized on the base end surface side of the tape cartridge 100 and the sensor unit 300 is in a state of being pressed against the base end surface of the tape cartridge 100. Moreover, in the embodiment, the unit energizing portion 304 is configured of the pair of right and left coil springs 306, but is not limited to the embodiment as long as the unit energizing portion 304 is capable of energizing the sensor unit 300.

Figure 9:
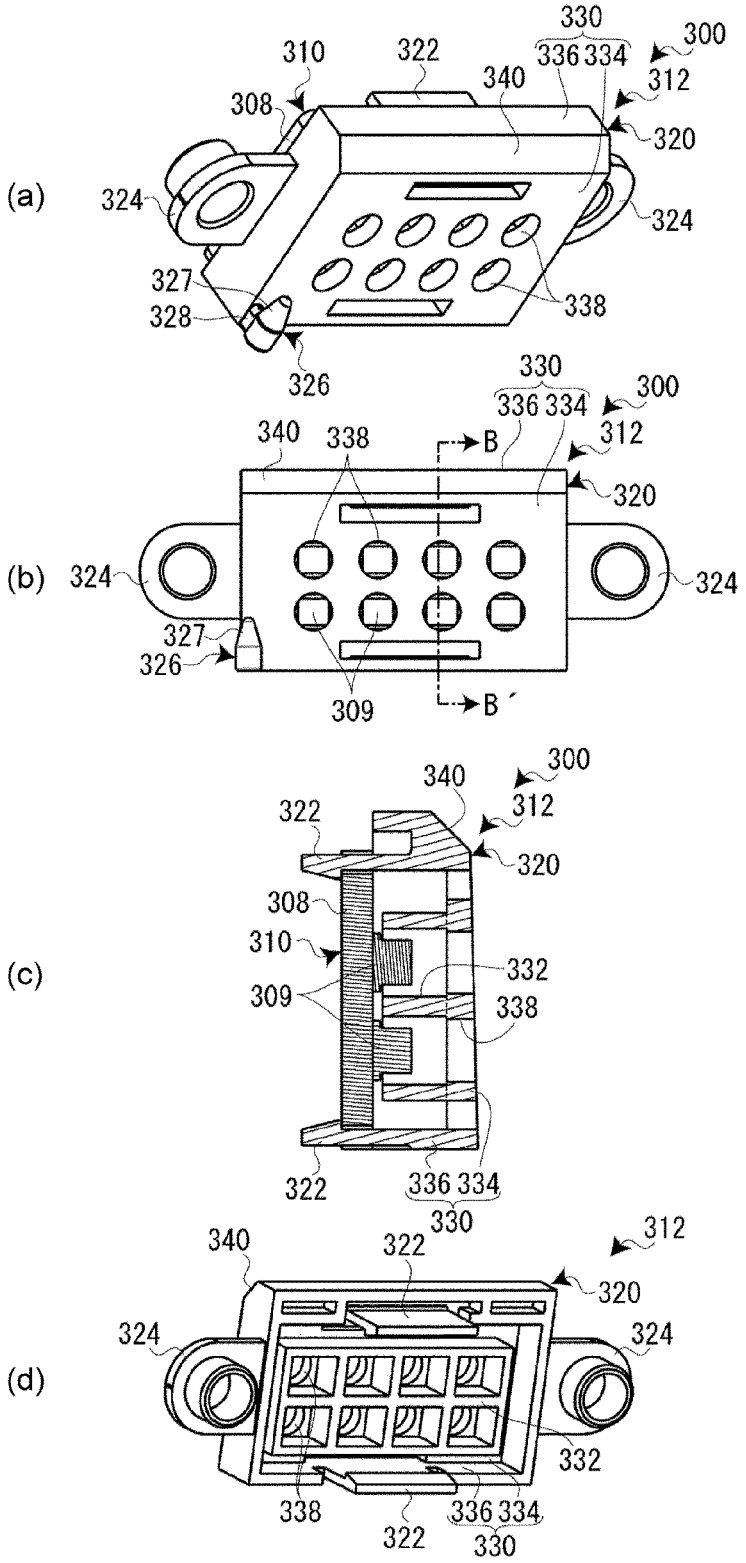
FIG. 9(*a*) is a perspective view and 9(*b*) is a front view of the sensor unit, 9(*c*) is a sectional view taken along line B-B' on 9(*b*), and 9(*d*) is a perspective view of a back surface of the sensor holder.

As illustrated in FIG. 9, the sensor unit 300 includes a sensor portion 310 (detection portion) where a plurality of optical sensors 309 are mounted on a sensor substrate 308 and a sensor holder 312 (holder) on which the sensor portion 310 is supported. The sensor substrate 308 is mounted on a base end portion of the sensor holder 312 in a posture following the base end surface of the tape cartridge 100. As described above, the sensor substrate 308 is mounted on the sensor holder 312. Therefore, the sensor holder 312 is in a state of supporting the sensor portion 310.

The plurality of optical sensors 309 are arranged in a matrix shape of two rows and four columns corresponding to the bit configuration portion 251 on the sensor substrate 308 (see FIG. 9(*b*)). In addition, the plurality of optical sensors 309 are respectively configured of a light reflection type optical non-contact sensor, applies a detection light to each bit configuration portion 251, and receives a reflection light from each bit configuration portion 251. As described above, each bit configuration portion 251 displays bit information by whether or not black ink is printed in the white printing region. Each optical sensor 309 detects whether or not black ink is printed in the printing region by presence or absence (strictly speaking, whether or not a received light amount is equal to or greater than a certain amount) of the reflection light from each bit configuration portion 251. The bit information displayed by each bit configuration portion 251 is read based on the detection result. The sensor portion 310 reads the bit information of each bit configuration portion 251 by the plurality of optical sensors 309. Therefore, the bit information of each bit configuration portion 251 is read and the specification information of the tape cartridge 100 corresponding thereto is read.

The sensor holder 312 includes a holder body 320 having a trapezoidal shape in a side view, a pair of upper and lower substrate mounting hooks 322 protruding from the holder body 320 to the base end side, the pair of right and left spring receiving portions 324 protruding from the base end portion of the holder body 320 to right and left sides, the positioning pin 326 (positioning protrusion portion) formed on a right tip side of the holder body 320, and the connection portion 328 connecting the positioning pin 326 and the holder body 320. Moreover, the holder body 320, the pair of substrate mounting hooks 322, the pair of spring receiving portions 324, the positioning pin 326, and the connection portion 328 are integrally formed (molded) of resin and the like.

The pair of substrate mounting hooks 322 mount the sensor substrate 308 on the sensor holder 312. That is, the sensor substrate 308 is mounted on the sensor holder 312 by the pair of substrate mounting hook 322.

The pair of spring receiving portions 324 are portions against which one end of the pair of coil springs 306 abut and which receives a energizing force of the pair of coil springs 306. The pair of spring receiving portions 324 abut against the side plate portion 33 of the cartridge mounting portion 5 and also functions as a front end regulation portion for performing regulation of the front end in the movement of the sensor unit 300 to the inside and the outside of the cartridge mounting portion 5.

The holder body 320 is configured of a sensor cover 330 that covers the sensor portion 310 (entirety of the plurality of optical sensors 309) and partition members 332 that individually surround each optical sensor 309. The partition members 332 extend rearward from a leading end wall 334 which is described later in the sensor cover 330 on the inside of the sensor cover 330, and individually surround each optical sensor 309. Therefore, the partition members 332 prevent the detection light reflected from the bit configuration portion 251 and incident on the optical sensors 309 from interfering between the optical sensors 309.

The sensor cover 330 has the leading end wall 334 configuring a tip end portion of the sensor cover 330 and a periphery wall 336 extending rearward from upper and lower, and right and left of the leading end wall 334. The sensor cover 330 covers the sensor portion 310 with the leading end wall 334 and the periphery wall 336, and suppresses the incidence of the external light to each optical sensor 309. That is, the sensor cover 330 functions as the external light shielding portion that shields disturbance light incident on the optical sensor 309. In addition, a plurality of sensor holes 338 corresponding to the plurality of optical sensors 309 are formed in the leading end wall 334. Each optical sensor 309 irradiates each bit configuration portion 251 with the detection light through each sensor hole 338 and receives a reflected light from each bit configuration portion 251 through each sensor hole 338.

In addition, the sensor cover 330 not only functions as the external light shielding portion, but also functions as a spacer that forms a predetermined interval (clearance) between the sensor portion 310 (each optical sensor 309) and the base end surface on which the specification reading pattern 145 is formed by being in contact with the base end surface of the tape cartridge 100. That is, the sensor cover 330 abuts against the base end surface by pressing of the leading end wall 334 against the base end surface of the tape cartridge 100 by energizing of the unit energizing portion 304 (the pair of right and left coil springs 306) while supporting the sensor portion 310. Thus, the position of the sensor portion 310 in the forward and rearward direction is positioned with respect to the base end surface. Therefore, the sensor cover 330 forms a predetermined interval between the sensor portion 310 and the base end surface, and makes the distance from the sensor portion 310 to the specification reading pattern 145 be the optimum distance. The "optimum distance" mentioned here is an optimum distance that enables the optical detection to be satisfactorily performed by each optical sensor 309 by taking a focal distance into consideration. Moreover, a surface of the leading end wall 334 being in contact with the base end surface of the tape cartridge 100 is formed to be inclined slightly downward so as to follow the base end surface.

Furthermore, a leading inclined surface 340 inclined downward is formed in the upper end portion on the leading end side of the sensor cover 330. The leading inclined surface 340 abuts against a corner portion between the base end surface and the rear surface in the tape cartridge 100, and causes a part (component force) of a force for mounting the tape cartridge 100 to act as a force for pushing the sensor holder 312 back when mounting the tape cartridge 100. When moving the tape cartridge 100, the sensor holder 312 extending to the mounting area of the tape cartridge 100 is pushed back to a position in which the mounting of the tape cartridge 100 is not interfered by the leading inclined surface 340. Therefore, the sensor holder 312 is in a state of being pressed against the base end surface of the tape cartridge 100 by a restoring force of the unit energizing portion 304 (the pair of right and left coil springs 306) generated by pushing of the sensor holder 312 back.

Figure 10:
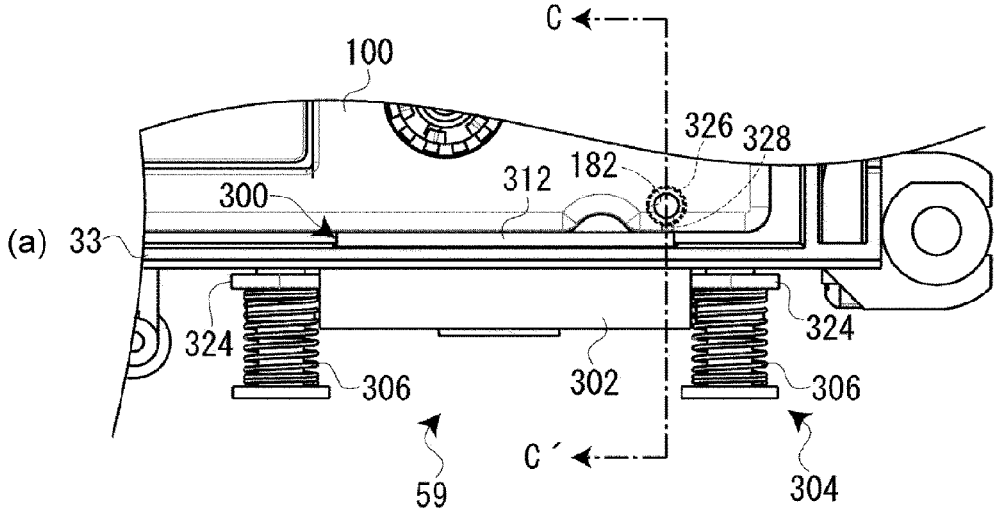
FIG. 10(*a*) is a plan view around the pattern reading portion and the positioning hole portion, and 10(*b*) is a sectional view that is taken along line C-C' on 10(*a*).
Figure 10:
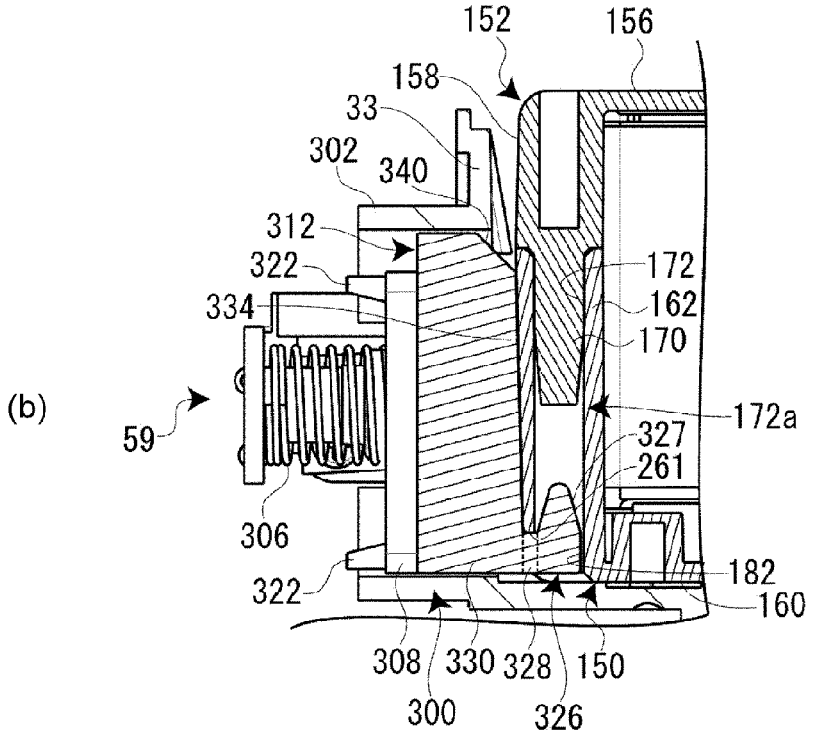

As illustrated in FIGS. 9 and 10, the positioning pin 326 is formed in a cylindrical shape which rises upward, tapered, and upright, and is engaged with the positioning hole portion 182 of the tape cartridge 100 from below. A tip end portion 327 of the positioning pin 326 is formed in a truncated cone shape an upper bottom surface portion thereof has a rounded dome shape. The positioning pin 326 of the sensor holder 312 engaged with the positioning hole portion 182 of the tape cartridge 100 and thereby the sensor portion 310 supported by the sensor holder 312 is positioned with respect to the specification reading pattern 145 formed in the tape cartridge 100. That is, in the embodiment, positioning is performed by the positioning pin 326 in addition to the positioning by pressing the sensor holder 312 against the base end surface of the tape cartridge 100. It is possible to further strictly perform positioning in the forward and rearward direction and positioning in the right and left direction can also be performed by the positioning by the positioning pin 326.

Figure 11:
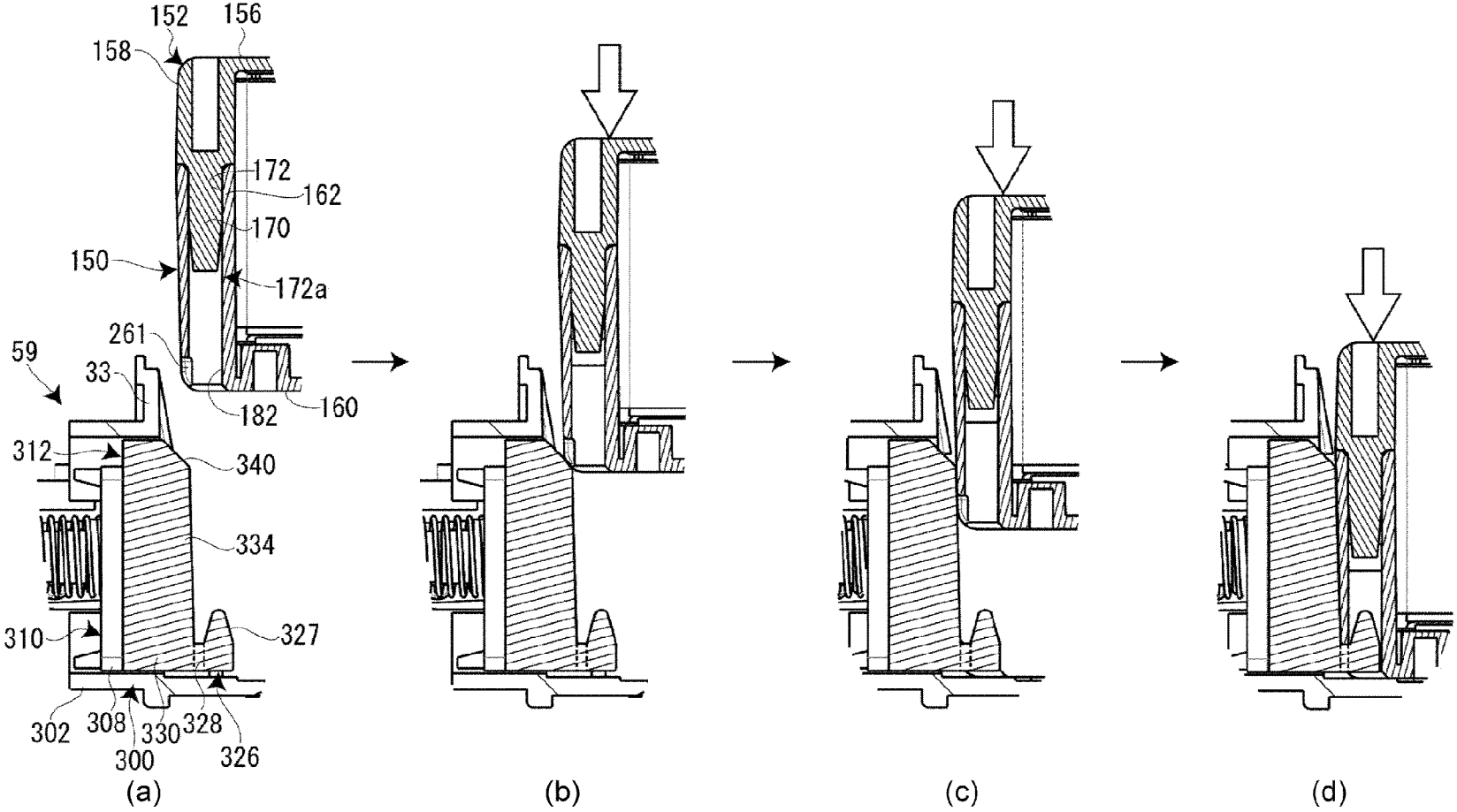
FIG. 11 is an explanatory view illustrating a mounting operation of the tape cartridge.

Next, a mounting operation of the tape cartridge 100 on the cartridge mounting portion 5 will be described with reference to FIG. 11. As illustrated in FIGS. 11(*a*) and 11(*b*), if the tape cartridge 100 is inserted into the cartridge mounting portion 5 from the front side (upper side) in the mounting direction, first, the corner portion between the base end surface and the rear surface in the tape cartridge 100 abuts against the leading inclined surface 340 of the sensor cover 330. Then, if the insertion is further advanced, the sensor unit 300 is pushed to the front side by the leading inclined surface 340 against the unit energizing portion 304. Thereafter, the sensor unit 300 is in a state of being pressed against the base end surface of the tape cartridge 100 (see FIG. 11(*c*)).

Thereafter, if the insertion is further advanced, the tape cartridge 100 continues to advance on the back side in the mounting direction while sliding to the sensor unit 300. The truncated cone shape (tapered surface) of the tip end portion 327 of the positioning pin 326 is in contact with an inner edge of the positioning hole portion 182, and the positioning hole portion 182 is engaged with the positioning pin 326 while the positioning of the sensor unit 300 is performed. Simultaneously, the rear surface of the tape cartridge 100 is seated on the cartridge mounting portion 5. That is, in a state in which the sensor unit 300 is pressed against the tape cartridge 100, the positioning pin 326 and the positioning hole portion 182 are further engaged, and in this state, the tape cartridge 100 is mounted. Therefore, the mounting operation is completed.

According to the above configuration, the sensor holder 312 that supports the sensor portion 310 is pressed against the formation surface (base end surface) of the specification reading pattern 145 to be in close contact with the formation surface, and thereby the position of the sensor portion 310 with respect to the formation surface can be positioned at the optimum position. That is, since the sensor holder 312 functions as a spacer formed at a predetermined interval between the sensor portion 310 and the formation surface, the distance from the sensor portion 310 to the specification reading pattern 145 can be set to the optimum distance. In addition, since the sensor holder 312 is in a state of being pressed against the forming surface for the specification reading pattern 145, even if the position of the tape cartridge 100 is shifted from the position during the mounting by an impact from the outside or the force from the various driving shafts of the tape printing device 1, the close contact state is maintained and the optimum distance can be maintained. Therefore, it is possible to improve the detection ability of the sensor portion 310.

In addition, an external light shielding structure (external light shielding portion) that shield the external light to the sensor portion 310 is provided in the sensor holder 312 which is in close contact with the formation surface (the base end surface) for the specification reading pattern 145. Therefore, the external light is incident between the sensor portion 310 and the formation surface. Therefore, it is possible to reliably prevent the external light from reaching the sensor portion 310. Thus, it is possible to further improve the detection ability by the sensor portion 310.

Furthermore, it is possible to prevent interference between the optical sensors 309 by providing the sensor holder 312 in the partition member 332. Therefore, it is possible to further improve the detection ability by the sensor portion 310.

Furthermore, it is possible to easily and automatically create a state in which the sensor holder 312 is pressed against the tape cartridge 100 by providing the leading inclined surface 340 in the sensor holder 312 without any special operation or control.

In addition, furthermore, the positioning pin 326 and the positioning hole portion 182 are engaged with each other by providing the positioning pin 326 engaging with the positioning hole portion 182 of the tape cartridge 100 in the sensor holder 312 in a state in which the sensor holder 312 is pressed against the tape cartridge 100. Therefore, the sensor holder 312 and the tape cartridge 100 can be further firmly in close contact with each other, and the sensor holder 312 and the tape cartridge 100 can be integrated. Therefore, the sensor portion 310 and the specification reading pattern 145 are further precisely positioned and the distance from the sensor portion 310 to the specification reading pattern 145 can further precisely be the optimum distance. In addition, it is possible to further firmly maintain the optimum distance. Furthermore, it is also possible to perform positioning in the right and left direction, and it is also possible to maintain a state of being positioned in the right and left direction.

Moreover, in the embodiment, a configuration in which the positioning pin 326 and the positioning hole portion 182 are engaged with each other and thereby the positioning in the right and left direction of the sensor portion 310 with respect to the specification reading pattern 145 is performed is provided, but it is not limited to the embodiment. For example, a configuration, in which a groove portion (positioning groove portion) extending in the upward and downward direction is formed on one of the base end surface of the tape cartridge 100 and a leading end surface (surface of the leading end wall 334) of the sensor holder 312, a rib (positioning rib) extending in the upward and downward direction, and engaging with the groove portion is formed on the other, and they are engaged with each other to perform the positioning in the right and left direction, may be provided.

In addition, in the embodiment, a configuration is provided in which the external light shielding structure that shields the external light to the sensor portion 310 is provided in the sensor holder 312, but a configuration, in which the external light shielding structure is provided in the tape cartridge 100, may be provided. For example, a configuration, in which a recessed portion which the tip end portion of the sensor holder 312 enters (falls) is formed on the base end surface of the tape cartridge 100 and the specification reading pattern 145 is formed on a bottom surface of the recessed portion (the specification reading seal 143 is adhered), may be provided. In addition, for example, a configuration, in which a rectangular tubular protrusion portion (corresponding to the periphery wall 336 of the sensor holder 312) surrounding the sensor holder 312 is formed on the base end surface of the tape cartridge 100, may be provided. Of course, the external light shielding structure may also be provided in both the sensor holder 312 and the tape cartridge 100, or the external light shielding structure may be provided in one of them. Moreover, the same applies to the partition member 332.

Furthermore, in the embodiment, a configuration, in which the leading inclined surface 340 is formed in the upper end portion on the tip side of the sensor holder 312, is provided, but a configuration, in which the leading inclined surface 340 is formed in the lower end portion on the base end surface side of the tape cartridge 100, may be provided.

Still further, in the embodiment, the unit energizing portion 304 is configured of the pair of right and left coil springs 306 that energize the upper and lower centers of the right and left ends of the sensor holder 312, but the unit energizing portion 304 may be configured of the pair of right and left coil springs 306 that energize the right and left centers of the upper and lower ends of the sensor holder 312. In this case, if a certain play is given between the unit support portion 302 and the sensor holder 312, the sensor holder 312 can swing like a yaw. Accordingly, an angle of the sensor holder 312 in the right and left direction (yawing direction) can be matched with the tape cartridge 100. As a result, the unit energizing portion 304 may be configured of upper two coil springs 306 and one lower coil spring 306, so that upper and lower ends of the sensor holder 312 may be energized by the coil springs.

In addition, in the embodiment, a digital optical sensor that outputs the detection result as digital data is used as the optical sensor 309, but an analog optical sensor that outputs the detection result as analog data may be used as the optical sensor 309. For example, Position Sensitive Detector (PSD) may be used.

In addition, in the embodiment, in order to protect each optical sensor 309, a configuration, in which a translucent protective film that transmits the detection light and the reflected light is attached to the leading end wall 334 of the sensor holder 312 while covering each sensor hole 338, may be provided. According to such a configuration, it is possible for a user to prevent each optical sensor 309 from touching.

REFERENCE SIGNS LIST

1: tape printing device
100: tape cartridge
145: specification reading pattern
182: positioning hole portion
300: sensor unit
304: unit energizing portion
309: optical sensor
310: sensor portion
312: sensor holder
326: positioning pin
332: partition member
340: leading inclined surface

CROSS REFERENCE TO RELATED APPLICATIONS

This application is a National Stage Entry of International Application PCT/JP2016/000670, filed Feb. 9, 2016; which claims priority to Japanese Patent Application No. 2015-055148 filed on Mar. 18, 2015, the entire contents of both of which are incorporated by reference herein.

The invention claimed is:

1. A tape printing device on which a tape cartridge is mounted, the device comprising:

a sensor unit that faces a portion to be detected formed on a predetermined wall surface of the tape cartridge; and an energizing portion that energizes the sensor unit toward a predetermined wall surface side, wherein the sensor unit has a detection portion that irradiates the portion to be detected with a detection light and reads the portion to be detected, and a holder that supports the detection portion and presses the predetermined wall surface by energizing of the energizing portion, and wherein the holder has a pair of receiving portions that protrude from opposing side surfaces of the holder and receive the energizing portion such that the sensor unit is energized toward the predetermined wall surface side via the pair of receiving portions.

2. The tape printing device according to claim 1, wherein the holder has an external light shielding portion that covers the detection portion and shields an external light incident on the detection portion.

3. The tape printing device according to claim 1, wherein the detection portion has a plurality of optical sensors, and from the portion to be detected and incident on the optical sensors from interfering with each other between the optical sensors.

4. The tape printing device according to claim 1, wherein the predetermined wall surface is a side wall surface that follows a mounting direction in which the tape cartridge is mounted, wherein an end portion of the holder on a front side in the mounting direction has a leading inclined surface, and wherein the leading inclined surface abuts against a corner portion of the tape cartridge on a back side in the mounting direction and causes a part of a force for mounting the tape cartridge to act as a force for pushing the holder back.

5. The tape printing device according to claim 1, wherein the predetermined wall surface is a side wall surface that follows the mounting direction in which the tape cartridge is mounted, and wherein the holder is formed with a positioning protrusion portion engaging with a hole portion formed on a wall surface on a back side in the mounting direction of the tape cartridge from the back side in the mounting direction.

6. A tape printing device on which a tape cartridge is mounted, the device comprising:

a sensor unit that faces a portion to be detected formed on a predetermined wall surface of the tape cartridge; and an energizing portion that energizes the sensor unit toward a predetermined wall surface side, wherein the predetermined wall surface is a side wall surface that follows a mounting direction in which the tape cartridge is mounted, wherein the sensor unit has a detection portion that irradiates the portion to be detected with a detection light and reads the portion to be detected, and a holder that supports the detection portion and presses the predetermined wall surface by energizing of the energizing portion, and the holder is formed with a positioning protrusion portion engaging with a hole portion formed on a wall surface on a back side in the mounting direction of the tape cartridge from the back side in the mounting direction, and is formed with a connection portion connecting the positioning protrusion portion and the holder and engaging with a cutout portion of the predetermined wall surface of the tape cartridge.

* * * * *